United States Patent [19]

Stähli

[11] Patent Number: 4,549,333

[45] Date of Patent: Oct. 29, 1985

[54] PROCESS FOR PREPARATION OF A ROW OF TWO DIFFERENT AND ALTERNATING TYPES OF DROP WIRES, AND AN ASSEMBLY RESULTING FROM SUCH PROCESS

[75] Inventor: Peter Stähli, Quarten, Switzerland

[73] Assignee: E. Fröhlich AG, Mühlehorn, Switzerland

[21] Appl. No.: 603,171

[22] Filed: Apr. 23, 1984

[30] Foreign Application Priority Data

Apr. 22, 1983 [DE] Fed. Rep. of Germany ..... 3314615

[51] Int. Cl.[4] ..... D03J 1/14

[52] U.S. Cl. ..... 28/205

[58] Field of Search ..... 28/203, 204, 205, 206, 28/207, 208

[56] References Cited

U.S. PATENT DOCUMENTS 3,349,811 10/1967 Kaufmann ..... 28/205

3,744,109 7/1973 Dohi et al. ..... 28/206

*Primary Examiner*—Henry S. Jaudon

*Attorney, Agent, or Firm*—Watson, Cole, Grindle & Watson

[57] ABSTRACT

For pinning of drop wires for the mechanical drawing-in of warp threads, the keyholes thereof located at different distances from the thread eyes in two different types of drop wires must be aligned with one another for the reception of a pinning rod. Both types of drop wires are thus strung onto a lease rod which passes through the thread eyes of both types of drop wires, the lease rod having a T-shaped cross-section at one end segment and a rectangular cross-section at an opposite end segment with an intermediate gradual transition of increasing thickness of the T-crossbar portion of the T-shaped cross-section. The thread eye of one type drop wire has a cutout defining opposed projections engaging upper surfaces of the T-crossbar, and the drop wires of the other drop wire type which are not intended to be displaced have an upper thread eye portion which is of essentially the same size and shape as the rectangular-sectioned segment of the lease rod.

6 Claims, 16 Drawing Figures

PROCESS FOR PREPARATION OF A ROW OF TWO DIFFERENT AND ALTERNATING TYPES OF DROP WIRES, AND AN ASSEMBLY RESULTING FROM SUCH PROCESS

BACKGROUND OF THE INVENTION

This invention relates to a process for the preparation of a row of two different and alternating types of drop wires for the automatic drawing-in of a warp for a weaving machine, in which the drop wire types each have a thread eyelet spaced the same distance from an end thereof, each have an identical elongated slot spaced the same distance from the other end thereof for the reception of a rack rail or a contact rail of a warp stop motion device on which the drop wires are adapted to hang, and each have a keyhole spaced from the thread eye in one of the types of drop wires a different distance than the spacing of a keyhole from the thread eye in the other of type drop wires, and wherein a lease rod is employed for displacement of a first the two types of drop wires along the longitudinal axes thereof until the keyholes of all the drop wires are aligned between drop wires to facilitate reception of a pin for the pinning of the drop wires.

This invention further relates to an assembly of two different and alternating types of drop wires prepared by the above process.

Thus, the invention relates to drop wires which are suitable for the automatic drawing-in of warps and which have for such purpose a keyhole near the thread eye in each drop wire, through which a rod or a round bar having a helical tip is passed so that the warp threads can thereby be drawn-in. The pinning of the drop wires can only take place when in the stack of drop wires the keyhole slots extend from the circular hole thereof upwardly for one type drop wire and downwardly from the other type drop wire. This so-called 1-1 pinning of the drop wires must first be arranged to facilitate the automatic drawing-in of warp threads.

The two drop wire types, which differ from one another according to whether the key hole slot extends upwardly or downwardly, also differ in that the distance of the key hole from its thread eye is greater for one drop wire type than for the other drop wire type. This distance of the key hole from the thread eye which, in all drop wires is located at the same distance from one drop wire end, is made deliberately larger, so that during mill operations the keyholes of the drop wires do not align with one another, since otherwise a strand of lint consisting of dust and fibers can easily form in a row of aligned holes, which can compromise the free mobility of individual drop wires, so that a predetermined operating readiness of the warp stop motion device cannot be assured.

In order to introduce the rod with its helical end into the keyholes required for the pinning of the drop wires, all those drop wires in a drop wire row hanging on an auxiliary rod must first be raised for those having the keyhole spaced a greater distance from its thread eye as compared to those remaining drop wires having the keyholes lying at a smaller distance from their thread eyes. If the correct 1-1 threading for pinning the drop wires in the drop wire row is already present, any other drop wire in the row must be raised up. However, since errors are usually encountered during preparation for automatic drawing-in of warp threads, it becomes necessary to add or reduce the number of drop wires, so that there is no assurance that a row of drop wires prepared for a device for automatic drawing-in of warp threads has the correct drop wire threading sequence in which a drop wire with a keyhole slot extending upwardly is alternately succeeded by a drop wire in which the slot extends downwardly. For the preparation of a drop wire row for automatic drawing-in of warp threads, two conditions must therefore be fulfilled, i.e., all drop wire keyholes must be aligned, and the correct 1-1 threading must be present.

According to the prior art as shown in FIGS. 1 and 2, the lower ends of both drop wire types 101 and 102 are provided with upwardly extending recesses 103 and 104 so that a row of alternating drop wires 101 and 102 can be arranged using a lease rod matching the depth of recesses 103 so that drop wires 102 with the shallower recesses 104 can be raised upwardly. Otherwise, as shown in FIGS. 3 and 4 according to a further prior art approach, drop wires 105 and 106 of both types have, at their elongated slots 107 and 108 through which the rack rail or contact rail of the warp stop motion device passes, rounded holes 109 and 110 formed in the edges of these slots. Holes 109 are located at different distances from thread eye 111 thereof as compared to the distance between holes 110 and thread eyes 112 thereof. Therefore, upon insertion of a pointed lease rod through holes 109 and 110, drop wires 106 will be raised relative to drop wires 105. However, because of holes 109 and 110 the drop wires can remain hanging on the rack rail, and with the differently sized recesses in the lower ends of the drop wires 101 and 102, the assembled drop wires do not function as well as intended, because the drop wires which lie close to each other in a row can stick to one another, in that sizing residue from the warp threads can cling to the drop wires. Thus, with this movement of the drop wires relative to one another there is no driving motion which is determined by form.

SUMMARY OF THE INVENTION

The object of the present invention is to provide drop wires for avoiding the aforedescribed problems in such a manner as to ensure an absolutely certain longitudinal displacement of the drop wires of one drop wire type relative to the drop wires of the other drop wire type so that absolute certainty results from the form-determined driving motion of the drop wires, in such a manner that the keyholes will be aligned with one another and the rod for pinning the drop wires can be passed therethrough without hindrance. In accordance with the invention, a lease rod is inserted through the thread eye of all the drop wires of both drop wire types. The lease rod has a first segment of length at one end with a T-shaped cross-section, and a second segment of length at its opposite end with a rectangular cross-section, and intermediate these segments there is located a segment of length with constantly increasing thickness of the crossbar of the T from the first end segment to the second end segment. Thus, curved paths are formed at the intermediate segment of length during relative shifting of the drop wires along the length of the lease bar upon insertion thereof through the thread eyes. The thread eye in all drop wires of both types of drop wires has a cutout portion of equal width transverse to the longitudinal axis which conforms to and receives the rectangularly sectioned segment of the lease rod. And, the thread eyes of all the drop wires of both drop wire types have further cutout portions having narrowed sides defining opposing projections and shoulders such that when the drop wires are arranged to hang on the lease rod, the projections engage the upper surfaces of the T-crossbar of the T-shaped cross-sectional segment of length of the lease bar, and the shoulders engage the undersurface of the lease bar. During movement of all the drop wires along the lease bar the drop wires are automatically guided along curved paths at the intermediate length segment so as to displace all the drop wires of the first drop type relative to all the drop wires of the second drop type until the keyholes of all the drop wires are perfectly aligned when all the drop wires are arranged on the rectangularly cross-sectioned segment of length of the lease rod. With such gradual shifting and matching shapes between the lease rod and the thread eyes, defects are avoided in the event the drop wires stick to one another.

BRIEF DESCRIPTION OF THE DRAWINGS

FIGS. 14 and 15 are cross-sectional views of the lease rod taken substantially along the lines 14—14 and 15—15, respectively, of FIG. 13.

DETAILED DESCRIPTION OF THE INVENTION

Figure 1:
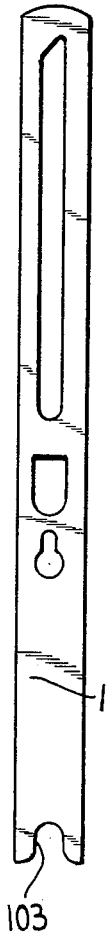
FIG. 1 (PRIOR ART)
FIGS. 1 and 2 are side elevational views of two types of drop wires according to the prior art.
Figure 2:
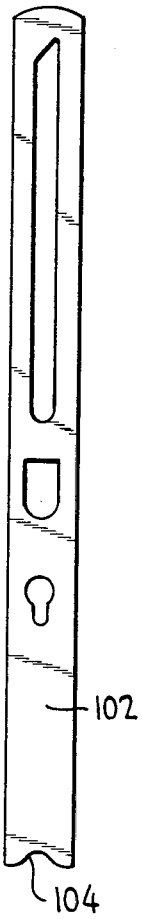
FIG. 2 (PRIOR ART)
Figure 3:
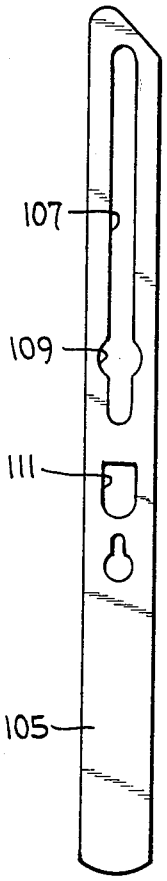
FIG. 3 (PRIOR ART)
FIGS. 3 and 4 are side elevational views of two other types of drop wires according to the prior art.
Figure 4:
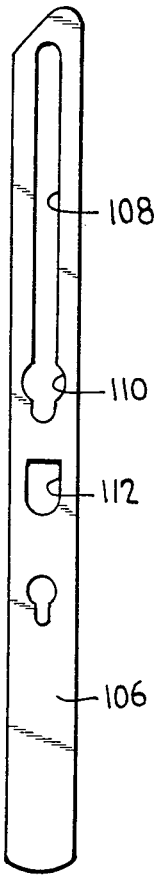
FIG. 4 (PRIOR ART)
Figures 5, 6, 7, 8, 9, 10, 11, 12:
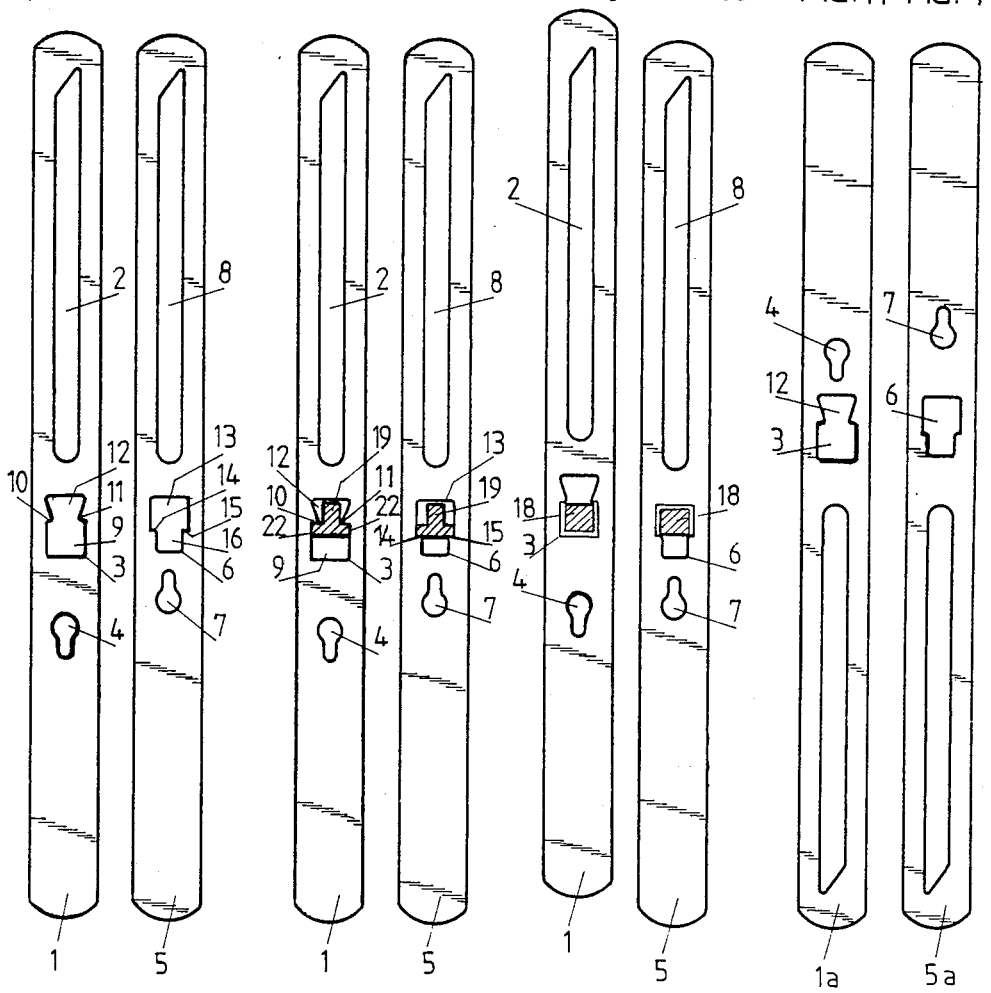
FIGS. 5 and 6 are side elevational views of two different types of drop wires according to one embodiment of the invention.
FIGS. 7 and 8 are views similar to FIGS. 5 and 6 but with a sectioned lease rod shown relative to the thread eyes during the initial insertion of the lease rod therethrough.
FIGS. 9 and 10 are views similar to FIGS. 7 and 8 but with the sectioned lease rod shown when extended fully through the thread eyes with one of the drop wire types longitudinally displaced.
FIGS. 11 and 12 are side elevational views of two different types of drop wires according to another embodiment of the invention.

Turning now to the drawings wherein like reference characters refer to like and corresponding parts throughout the several views, a drop wire 1 of one type in FIG. 5 has a longitudinal slot 2 through which the contact rail or rack rail of the warp stop motion device is inserted. And, drop wire 1 further has a thread eye 3 and a keyhole 4 at a given spacing below the thread eye, with the slot of the keyhole extending downwardly from the circular hole portion thereof. This drop wire 1 of one drop wire type differs from drop wire 5 of another drop wire type shown in FIG. 6 in the configuration of thread eye 6 thereof, and in the configuration and relative location of keyhole 7. Thus, keyhole 7 of drop wire 5 is located a shorter distance from its thread eye 6 as compared to the distance between thread eye 3 and keyhole 4 of drop wire 1. Moreover, the slot portion of keyhole 7 extends upwardly from the circular portion thereof. Drop wire 5 has a longitudinal slot 8 which is identical in shape and distance from the adjacent end of the drop wire to that of longitudinal slot 2 of drop wire 1, and is provided for the same purpose.

Thread eye 3 of drop wire 1 has a lower cutout portion 9 and an adjoining upper cutout portion 12 having a narrowed width defining opposing projections 10 and 11.

Thread eye 6 of drop wire 5 (FIG. 6) has cutout portion 13 corresponding in size to the rectangularly shaped cutout 9 of thread eye 3, although cutout 13 is located at the upper end of thread eye 6. And, this upper cutout portion 13 is adjoined by a lower cutout portion 16 having a narrowed width defining opposing shoulders 14 and 15.

Figure 13:
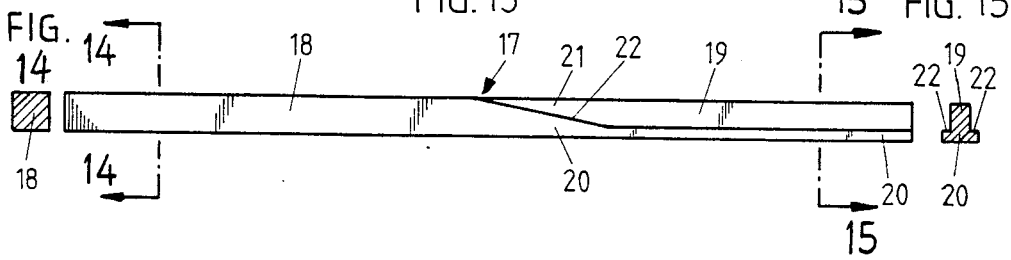
FIG. 13 is a side elevational view of the lease rod according to the invention.

In order to align the circular hole portions of keyholes 4 of all drop wires 1 with the circular hole portions of keyholes 7 of all drop wires 5, all drop wires 1 must be raised in the drop wire row. For this purpose a lease rod 17 of FIG. 13 is inserted in each drop wire through the thread eyes which are positioned in the covering position and which are aligned when stacked together face-to-face in the FIGS. 5, 6 and 7, 8 positions. Lease rod 17 has a segment of length 18 with a rectangular cross-section shown in FIG. 14, and has another segment of length 19 of T-shaped cross-section shown in FIG. 15. Segment of length 19 with its T-shaped cross-section includes a T-crossbar 20. And, a segment of length 21 intermediate segments 18 and 19 of the lease rod has a continually increasing thickness of its T-crossbar 20, so that upper drop wire engaging surfaces 22 of segment 19 merge gradually along straight lines, defining drop wire engaging surfaces 23, with an upper drop wire engaging surface 18*a* of segment 18. Thus, curved paths at segment 21 are formed as will be seen during insertion of the lease rod through the thread eyes from the segment 19 end and coming to rest on the segment 18 end.

In FIGS. 7 and 8, segment of length 19 of lease rod 17 is shown in cross-section after such segment has been extended through thread eyes 3 and 6 of a pair of drop wires 1 and 5 lying face-to-face. It will be seen that projections 10 and 11 of thread eye 3 of drop wires 1 will rest on upper surfaces 22 of cross bar 20. When all drop wires 1 are displaced to the left, when viewed in FIG. 13, along the lease rod, projections 10 and 11 will be guided along sloping surfaces 23, so that all drop wires 1 of the one drop wire type are raised and successively assume the position of FIG. 9 relative to FIG. 10, in which projections 10 and 11 now engage upper surface 18*a* of segment of length 18 of the lease rod. FIGS. 8 and 10 show that lease rod 17 passes only through the upper cutout portion of thread eye 6 of drop wire 5, so that shoulders 14 and 15 engage the lease rod from below. The thickness of the lease rod in a vertical direction is substantially the same as the height of both cutout portions 9 and 13 of thread eyes 3 and 6, so that the upper surface at segment 19 will likewise engage the upper edge of cutout portion 13, and rectangular segment 18 substantially fills cutout portions 9 and 13 as shown in FIGS. 9 and 10. And, lower cutout portion 16 of thread eye 6 has no function during lease rod insertion, and is provided so that the thread eyes of all the drop wires will be of equal height. Lease rod 17 could also be inverted when inserted with the T-crossbar lying uppermost and inserted through the thread eyes of all drop wires. Thus, it would be inserted through cutout portion 16 of thread eye 6 so that the relationship for both drop wire types will be changed, although relative actual displacement between drop wire types is assured.

Another embodiment of both drop wire types 1*a* and 5*a* is shown in FIGS. 11 and 12 wherein the keyholes and the elongated slots are on opposite sides of the thread eyes relative to that of FIGS. 5 and 6, such that drop wires will hang inverted on the lease rod. Otherwise, drop wires 1*a* are relatively displaced along the longitudinal axes thereof similarly as aforedescribed.

Figure 16:
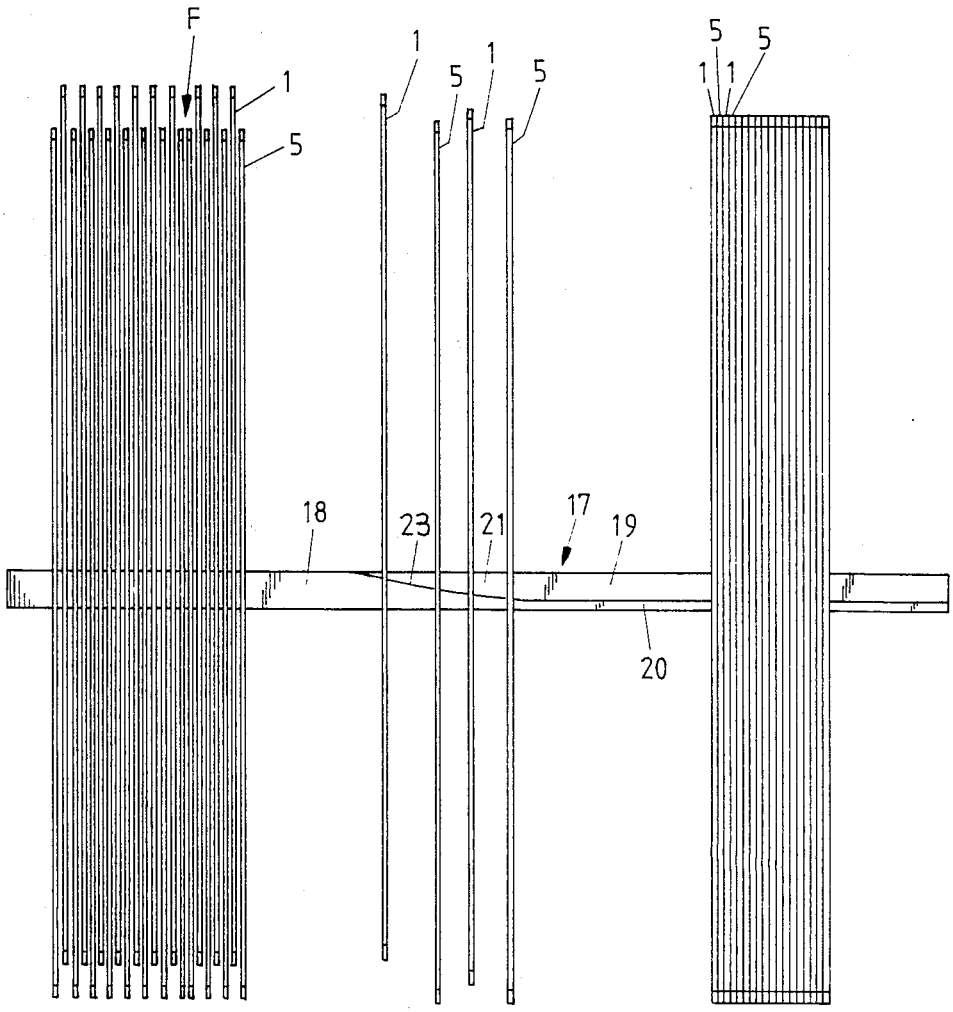
FIG. 16 is a side elevational view of the process of preparing a row of the two different and alternating types of drop wires according to the invention.

FIG. 16 illustrates from the right side thereof drop wires of both drop wire types threaded onto segment of length 19 of the lease rod with their thread eyes all aligned. In order to be correctly threaded in the row a drop wire 1 and a drop wire 5 must succeed one another alternately. This alternating arrangement of the two types of drop wires is clearly illustrated at intermediate segment 21 of the lease rod at which, during this leftward movement, all drop wires 1 are gradually displaced upwardly while contacting surfaces 23, while all drop wires 5 of the other drop wire type merely slide leftwardly with no vertical displacement relative to drop wires 1. In the drop wire row at the left side of FIG. 16, both drop wire types can be clearly distinguished visually so that any error in the corrected drop wire threading sequence, in which drop wires 1 and 5 must alternately succeed one another for the subsequent mechanical isolation of drop wires 1 and 5, can be detected as shown at arrow F. There, a larger gap is presented between the upper ends of drop wires 1 since two drop wires 5 follow one another in error. This gap is also recognizable even when the drop wires lie closely adjacent one another, although in the present drawing they are represented for clarity with a somewhat larger spacing. The drop wire row can now be separated at gap F to correct the error in threading. In the drop wire stack at the left side of FIG. 16 the keyholes of all drop wires are at the same level so that the rod, by means of which the drop wires are pinned, can be introduced into the circular portions of such keyholes.

Only a portion of lease rod 17 is shown in FIG. 16 and the drop wire rows shown at the left and right sides can be substantially more extensive. Manipulation with the lease rod remains, however, quite simple, since the lease rod must only be maintained on a slant in order for the drop wires to slide downwardly from the right side one-by-one over intermediate segment 21. Thus, both drop wire types are automatically separated as a result of the form-determined guidance between thread eye and surfaces 23, even if they should stick together, with the result that errors are avoided.

Obviously, other modifications and variations of the present invention are made possible in the light of the above teachings. It is therefore to be understood that within the scope of the appended claims the invention may be practiced otherwise than as specifically described.

What is claimed is:

1. A process for preparation of a row of two different and alternating types of drop wires for the automatic drawing-in of a warp for a weaving machine, wherein said drop wire types each have a thread eye spaced the same distance from one end thereof, each have an identical elongated slot spaced the same distance from the other end thereof for the reception of a rack rail or a contact rail of a warp stop motion device on which the drop wires are adapted to hang, and each have a keyhole spaced from said thread eye in one of said types of drop wires a different distance than the spacing of a keyhole from said thread eye in the other of said types of drop wires, and wherein an elongated lease rod is employed for displacement of a first of said two types of drop wires along their longitudinal axes until said keyholes of all said drop wires are aligned between said drop wires to facilitate the reception of a pin for the pinning of said drop wires, comprising the steps of providing said thread eyes of said one and said other of said types respectively with relatively spaced apart rod engaging means, providing said lease rod with first and second transversely spaced apart surface means at one end segment thereof for respectively engaging said engaging means, said first and second surface means being coincident at an opposite end segment of said lease rod, and passing said lease rod through said thread eyes with said surface means in engagement with said engaging means for effecting said displacement of said first type of drop wires.

2. An assembly of two different and alternating types of drop wires arranged with the use of a lease rod for the automatic drawing-in of a warp for a weaving machine, wherein said drop wire types each have a thread eye spaced the same distance from one end thereof, each have an identical elongated slot spaced the same distance from the other end thereof for the reception of a rack rail or a contact rail of a warp stop motion device on which the drop wires are adapted to hang, and each have a keyhole spaced from said thread eye in one of said types of drop wires a different distance than the spacing of a keyhole from said thread eye in the other of said types of drop wires, said lease rod effecting displacement of a first of said two types of drop wires along their longitudinal axes until said keyholes of all said drop wires are aligned between said drop wires to facilitate reception of a pin for the pinning of said drop wires, the improvement wherein said thread eyes of said one type of drop wires are differently shaped from said thread eyes of said other type of drop wires, each of said thread eyes having a first cutout portion for the reception of said lease rod, and said thread eyes of said one type of drop wires having a second cutout portion defining a pair of opposed projections, said lease rod having first surface means for engaging said projections and second surface means for engaging upper edges of said first cutout portions of said other type of drop wires, said first and second surface means being parallel at one end segment of said lease rod, being coincident at an opposite end segment of said lease rod, and said first surface means gradually merging into said second surface means at an intermediate segment of said lease rod, whereby said displacement of said first type of drop wires is effected upon insertion of said lease rod through said thread eyes as said second surface means engages said projections at said intermediate segment.

3. The assembly according to claim 2, wherein said one segment end of said lease rod is of T-shaped cross-section, and said opposite end segment of said lease rod is of rectangular cross-section, said first cutout portions of said thread eyes being rectangular and of substantially the same size as said rectangular cross-section.

4. The assembly according to claim 3, wherein the length of said second cutout of said one type of drop wires in the longitudinal direction of said drop wires is equal to the relative spacing between said keyholes of said one and said other types of drop wires.

5. The assembly according to claim 4, wherein said second cutout is spaced further from said keyhole in said one type of said drop wires than said first cutout thereof is spaced therefrom, and wherein the distance between said thread eye and said keyhole in said drop wires of said one type is greater than the distance between said thread eye and said keyhole in said drop wires of said other type.

6. The assembly according to claim 4, wherein said second cutout is spaced closer to said keyhole in said one type of said drop wires than said first cutout is spaced therefrom, and wherein the distance between said thread eye and said keyhole in said drop wires of said one type is less than the distance between said thread eye and said keyhole in said drop wires of said other type.

* * * * *